US009035161B2

(12) United States Patent
Campling

(10) Patent No.: US 9,035,161 B2
(45) Date of Patent: May 19, 2015

(54) CAPO

(71) Applicant: C7th LIMITED, Peterborough, Cambridgeshire (GB)

(72) Inventor: Nicholas John Campling, Peterborough (GB)

(73) Assignee: C7TH LIMITED (GB)

( * ) Notice: Subject to any disclaimer, the term of this patent is extended or adjusted under 35 U.S.C. 154(b) by 0 days.

(21) Appl. No.: 14/327,605

(22) Filed: Jul. 10, 2014

(65) Prior Publication Data

US 2015/0013520 A1 Jan. 15, 2015

(30) Foreign Application Priority Data

Jul. 12, 2013 (GB) ..... 1312495.3

(51) Int. Cl.
*G10D 3/04* (2006.01)

(52) U.S. Cl.
CPC ..... *G10D 3/043* (2013.01)

(58) Field of Classification Search
CPC ..... G10D 3/043
USPC ..... 84/317, 318
See application file for complete search history.

(56) References Cited

U.S. PATENT DOCUMENTS

| | | | | |
|---|---|---|---|---|
| 4,301,705 | A | 11/1981 | Gould | |
| 4,793,234 | A | 12/1988 | Geis | |
| 5,016,514 | A | 5/1991 | Kaufman | |
| 6,271,448 | B1 | 8/2001 | Steinberger | |
| 7,932,450 | B2 * | 4/2011 | Chen | 84/318 |
| 2004/0261600 | A1 | 12/2004 | Silva | |
| 2005/0257661 | A1 | 11/2005 | Einhorn et al. | |
| 2011/0023683 | A1 * | 2/2011 | Vochezer | 84/318 |

OTHER PUBLICATIONS

British Search Report Dated Jan. 2, 2014, Application No. GB1312495.3, Applicant C7th Limited, 3 Pages.

* cited by examiner

*Primary Examiner* — Kimberly Lockett
(74) *Attorney, Agent, or Firm* — Brooks Kushman P.C.

(57) ABSTRACT

A capo for use with a stringed instrument that includes a first arm 11 configured to, in use, extend laterally across a finger board and strings. A second arm is configured to, in use, abut against the back of a neck of the instrument to, in cooperation with the first arm, provide a clamping force over the strings. The first arm includes an adjustable tensioning means, e.g. a truss rod 14 or band, acting in a lengthwise direction, such that a contacting face can adapt to the curvature of the finger board. Adjustment is effected by a knob 15 or like device which tensions the truss rod or cable.

22 Claims, 3 Drawing Sheets

CAPO

CROSS-REFERENCE TO RELATED APPLICATIONS

This application claims foreign priority benefits under 35 U.S.C. §119(a)-(d) to GB 1312495.3, filed Jul. 12, 2013, which is incorporate by reference in its entirety.

TECHNICAL FIELD

The present invention relates to a capo for a stringed musical instrument, in particular a capo able to adapt to the curvature of a finger board to which it is applied.

BACKGROUND

A capo (sometimes referred to as a capodastro, capodaster, capotasto or cejilla) is a well-known device used with a stringed instrument, for example a guitar or banjo which has a neck and a set of strings extending along the length of the neck. The capo, when applied to an instrument neck, serves to clamp the strings against a finger board and, in particular, between or against one of the number of fret bars disposed along the length of the finger board. In practice a capo serves to reduce the effective length of the strings and therefore adjust the pitch; i.e. the pitch is raised as the effective length of a string is shortened.

A large number of different capo types are known, each of which has a different advantage and technical consideration. However, most standard capo designs feature a relatively rigid clamping bar which reaches over the strings in order to apply downward pressure thereon. It will be apparent that, in many cases, while there is often a shallow curvature built into the clamping bar, that curvature does not necessarily match the finger board, and/or the gauge of strings as on a particular neck, which can lead to uneven pressure being applied.

The present invention seeks to provide a means for a capo to have a clamping bar/arm that is adjustable to the finger board curvature (or lack thereof) which can be tailored for a particular instrument's finger board.

SUMMARY

According to a broad aspect of the invention, there is provided a capo as described in the accompanying claims. Particularly, the capo of the invention is for use with a stringed instrument having a neck with a back and a finger board with strings that extend longitudinally over said finger board, the capo including: a first arm configured to, in use, extend across the finger board over the strings; and an opposing element configured to, in use, abut against the back of the neck of the instrument to, in cooperation with the first arm, provide a clamping force over the strings; wherein the first arm includes an adaptive element for adapting to the curvature of the finger board and strings under the control of a threaded adjustment element.

Preferably the means for adapting curvature is an adjustable tensioning means and in a most preferred form of the invention the adjustable tensioning means is actuated by a single adjustment movement. Furthermore, the preferred tensioning means is arranged in a lengthwise direction. In the context of the invention "lengthwise" tensioning along the first arm is lateral to the strings and finger board of the instrument. Specifically the preferred embodiment of the invention is intended to employ the adjustable tensioning means, acting in a lengthwise direction, such that a contacting face of the first arm can adapt to the curvature of the finger board and strings thereon. In practice the required adaptive curvature for the capo of the invention is affected by both the finger board curvature and the gauge of strings.

The capability to adapt a contact surface of the capo to curvature as influenced by finger board and string gauges means that a generally harder contact material could be used resulting in different (often preferable) tonal qualities as the instrument is played. Soft rubber is commonly used on most capos to account for variation in curvature; however, a matched curvature between capo and finger board/strings provides the opportunity for alternative contact materials and effects.

The tensioning means is preferably a truss rod associated with the first arm (also referred to herein as a clamping or top arm). However, the tensioning means may also take the form of a band or cable held taught at two distal ends.

Preferably the truss rod or band is fixed at one end to the top arm and, at the opposite end, an adjustment means is provided for adjusting tension in the truss rod/band. In practice, tensioning a truss rod, which is a curved elongate element, causes it to straighten and, in the present context, the adjusted curvature is contactable to the strings. In the case of a band, its tension defines how displaced it will become when contacted to the strings over the finger board under the force of the capo's clamping action. Therefore, the band itself will not likely be curved until it is applied to the strings and the nature of the curve during operation depends on the tension in the band.

A first/clamping arm according to the invention may have a curve cast or otherwise built into it, wherein by virtue of the truss rod, curvature is reduced by manipulation of the adjustment mechanism. Alternatively, the first/clamping arm may remain substantially rigid (unbending) with a string contacting side only that is affected by the truss rod/band tension, via a spacer and/or rubber skin covering.

A material performing the string contacting function may be soft rubber or a considerably harder surface dependent on the desired tonal properties.

Preferably, the adjustment mechanism is a knob set against an external surface of the clamping arm, said knob having an internal screw thread to receive a matching screw thread at a distal end of the truss rod or attached to the band. Alternatively, adjustment may be achieved by use of a hex wrench (i.e. Allen key) in much the same way as a truss rod as found in a guitar neck is adjusted.

Guitar capos known in the art feature various clamping mechanisms (e.g. spring loaded lower arms, clutch or cam operated clamps or elastic elements which provide the clamping effect), however, most capos have a relatively rigid upper arm which must be held against the strings. Accordingly, the present invention can be applied to any capo with an upper clamping arm which is to be located over a set of strings.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
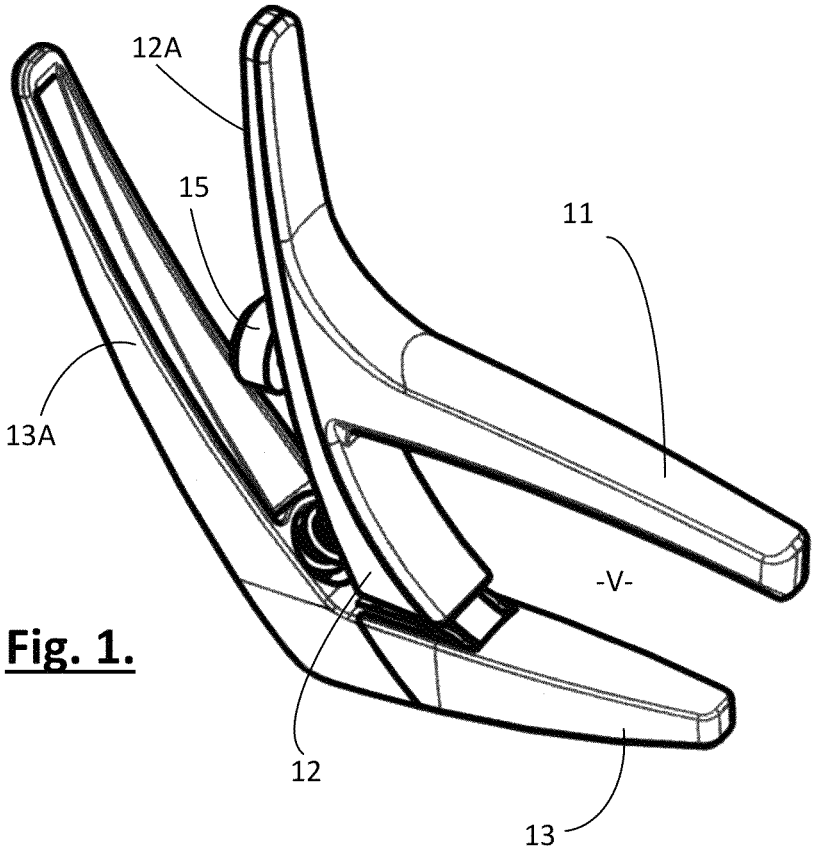
FIG. 1 illustrates a general view of a capo utilizing the adjustable curvature clamping arm according to the invention.
Figure 2:
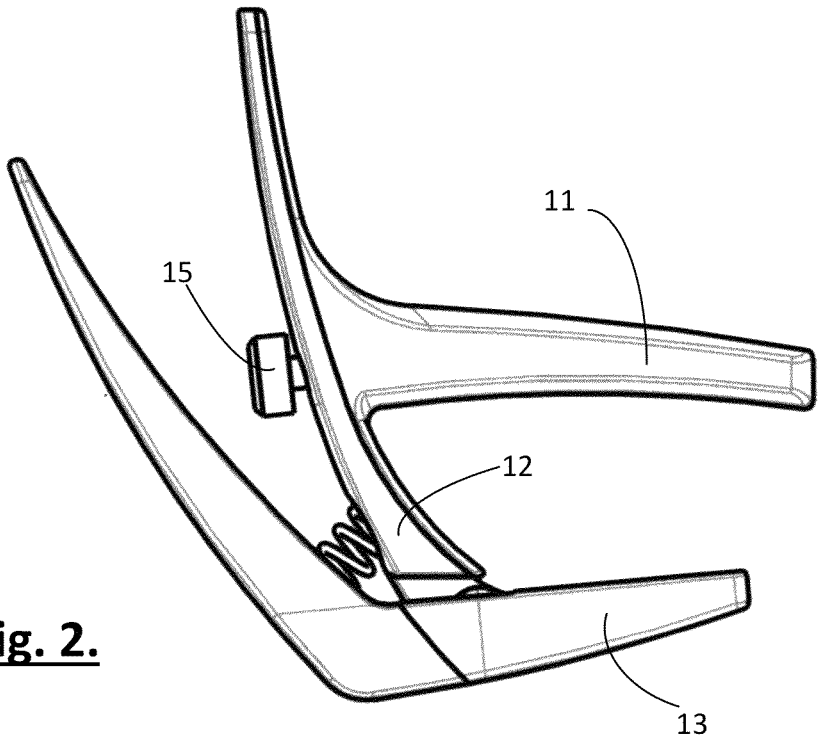
FIG. 2 illustrates a side elevation view of the capo from FIG. 1.
Figure 3:
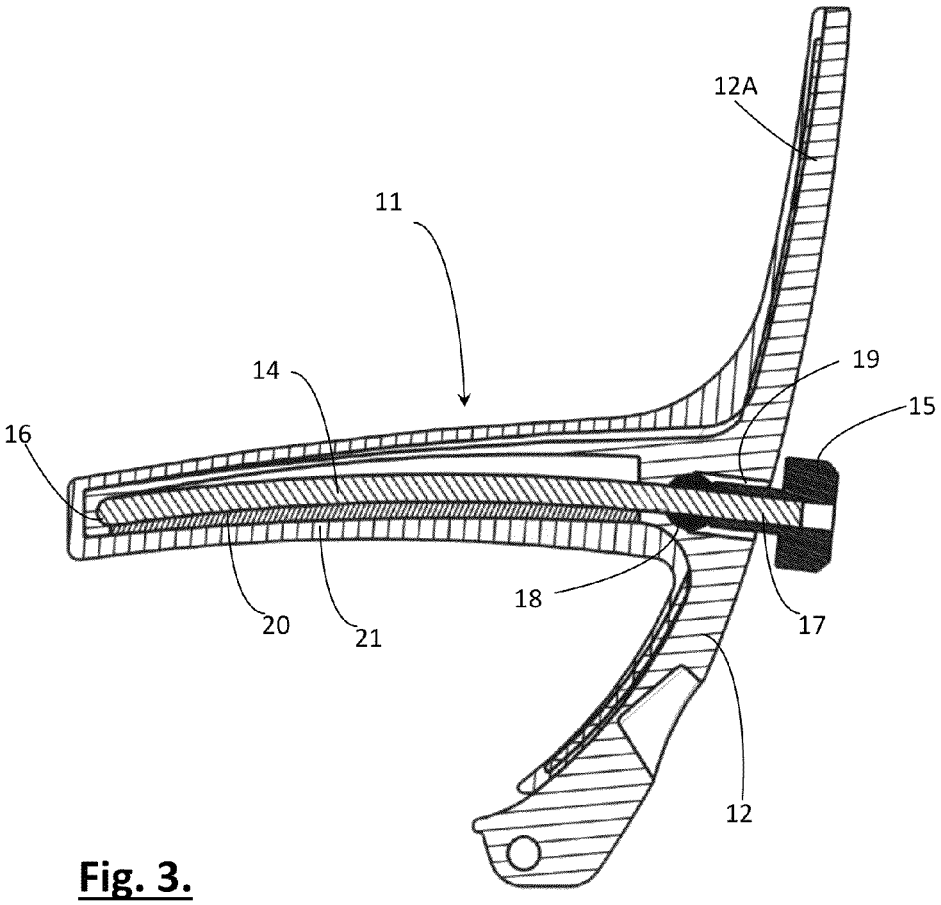
FIG. 3 illustrates a side elevation section view of the capo from the previous figures, incorporating a truss rod according to the invention.

By way of example, the attached drawing FIGS. 1 to 3 illustrate a type of spring loaded capo known in the art, incorporating the present invention. This capo type is described by U.S. Pat. No. 7,745,710. Referring to FIG. 1, a spring capo typically includes a top clamping arm 11, a downwardly extending arm 12 against which is biased a pivoting lower lever arm 13 which provides a clamping force to capture the combined neck/finger board/strings of an instrument within the void indicated by reference letter V. Pivoting of the lower arm 13 and adjustment of the capo is achieved by pinching together the extending portions 12A, 13A of arm 12 and lower arm 13 respectively.

In accordance with a preferred embodiment of the invention, a tensioning means in the form of truss rod 14 (not seen in FIGS. 1 and 2) is located within clamping arm 11 and an adjustment mechanism protrudes from one end which, in the illustrated form, is a knob 15 which is a threaded adjustment element. The tensioning means acts lengthwise on/within clamping arm 11 such that its substantive length in contact with a finger board is adjustable to the curvature of said finger board. The manipulation end of the adjustment mechanism, i.e. knob 15, is shown as located between the arms 12A/13A of the capo. In alternative forms the protruding knob or Allen key adjustment could be accessed from the distal free end of arm 11.

FIG. 3 illustrates the operational configuration of a truss rod 14 installed into a clamping arm 11. Specifically, the truss rod is anchored at one end 16 and the other end 17 is engaged with adjustment mechanism 15, in this case a knob with an internal thread which received a corresponding thread on the truss rod end 17. Preferably, the adjusting knob 15 includes a pivotable end 18, abutted against a corresponding recess 19 cast into the clamp arm/capo which enables a small degree of movement as the knob is tightened.

Pivot end 18 may be a boss located within a bore in a sidewall of the capo, including a hole through which the truss rod passes, while providing a surface against which the end of the shaft of knob 15 abuts. Alternatively, the pivot end 18 may be a ball shape integral with the shaft of knob 15.

The general principle of a truss rod as utilized in the present invention is similar to the truss rod in a conventional instrument neck. That is to say, tightening the adjusting knob 15 in an attempt to "pull", via a screw thread, the truss rod away from its anchor point 16, causes the truss rod 14 to straighten from its natural curvature as illustrated in FIG. 3. Straightening of the truss rod is able to cause a corresponding straightening/deflection of a spacer 20 which, in turn, deflects a rubber covering 21 that is in contact with a set of strings on the instrument (not illustrated). Spacer 20 may be a hard but flexible material such as acetal or nylon. The material which is to be contactable to the strings may be hard or soft, depending on the desired tonal properties. A maximum curvature must be built in to the truss rod at rest with the ability to, preferably, completely straighten; corresponding to a flat finger board.

It will be apparent from the illustrated embodiment that the substantive clamping arm 11 structure does not need to visibly straighten, because it is still generally cast from a rigid metal construction, however, the underside portion of the clamping arm in contact with the strings (rubber covering 21) does exhibit a curvature which can be adjusted, towards a flat configuration, such that the capo can be tailored to conform with the curvature of the instrument finger board and/or strings to which it is applied.

In alternative forms of the invention the clamp arm may be cast in a curved form from plastic (or otherwise from a material with some flexibility) where a truss rod is provided internally for structural strength, and the straightening of which causes a corresponding straightening of the plastic clamp arm.

A yet further form of the invention features a band or cable in place of the truss rod, but otherwise similarly configured as illustrated. Tension in the band, therefore, will dictate to what degree the spacer/rubber covering on the underside of arm 11 will deform as the capo is applied to a set of strings. Low tension will enable deformation to a high curvature to be accommodated whereas high tension is more suitable for shallow curvatures.

Use of a band is also possible in conjunction with a deformable clamp arm (e.g. of plastic as described above) to set a curvature in the clamp arm itself.

Figure 4A:
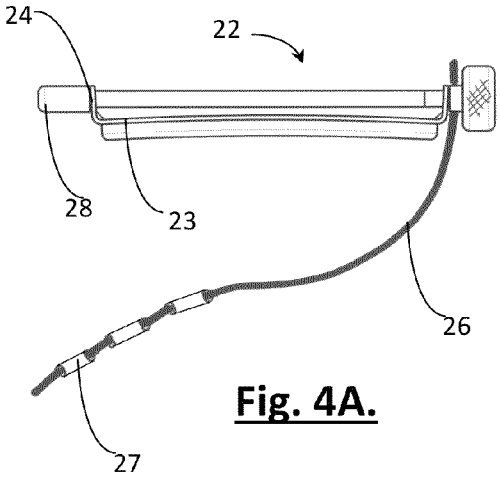
FIGS. 4A and 4B illustrate an alternative embodiment of the invention.
Figure 4B:
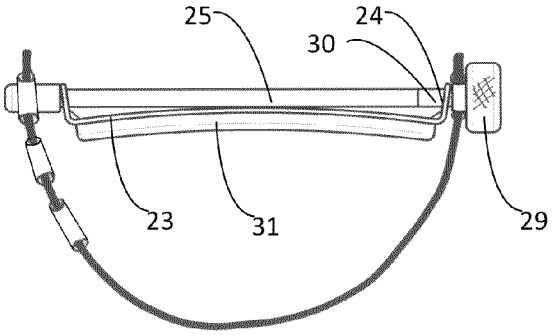

A yet further embodiment of the invention may feature a screw-tightened vice-like device applying pressure at one or both ends of a resilient face of the clamp arm, causing a greater curve to form in the arm as the ends of the vice move toward each other. In a variation of this concept FIG. 4 illustrates a capo 22 with a resilient lengthwise element 23 that, in use, spans the strings of an instrument (not illustrated). Element 23 includes upstanding flanges 24 (which may include strengthening gussets) at either end through which a shaft 25 is engaged; wherein this combined construction comprises a "first arm" for clamping the strings. Said first arm cooperates with an elastic or otherwise flexible band 26 that includes a series of apertures 27 to be received by a protruding part 28 of the shaft. In the known way, this allows for the capo to be affixed to an instrument neck over the finger board by a stretch force.

As illustrated (comparing FIGS. 4A and 4B), turning a knob 29 which is a threaded adjustment element, received on a threaded portion 30 of shaft 25, causes a tightening force against a proximate flange 24 such that it will adjust the curvature of element 23 (and, in effect, also a softer rubber covering 31 adhered to its string facing surface). In the preferred form, shaft 25 is stationary and held in place by a tight fit or other fixing with a distal flange 24; however, in alternative forms the shaft may turn with knob 29, cooperating with an internal thread of a flange 24.

The resilient element may be formed with an inherent curvature or relatively flat dependent on whether the tightening force is intended to cause a straightening or bowing of the element respectively. Either is possible and down to the choice of the skilled person and design constraints.

Figure 5A:
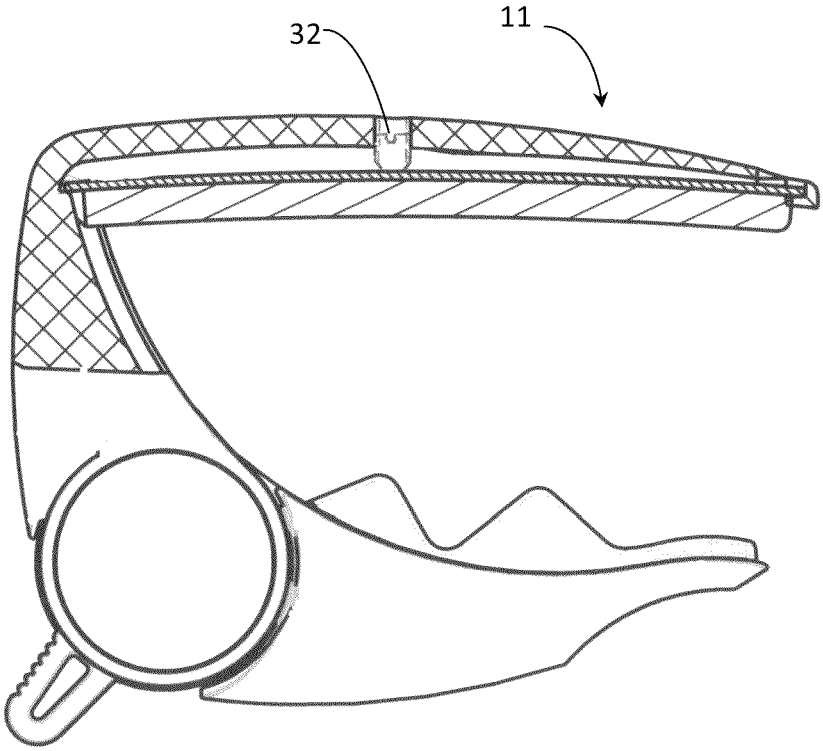
FIGS. 5A and 5B illustrate a yet further embodiment of the invention.
Figure 5B:
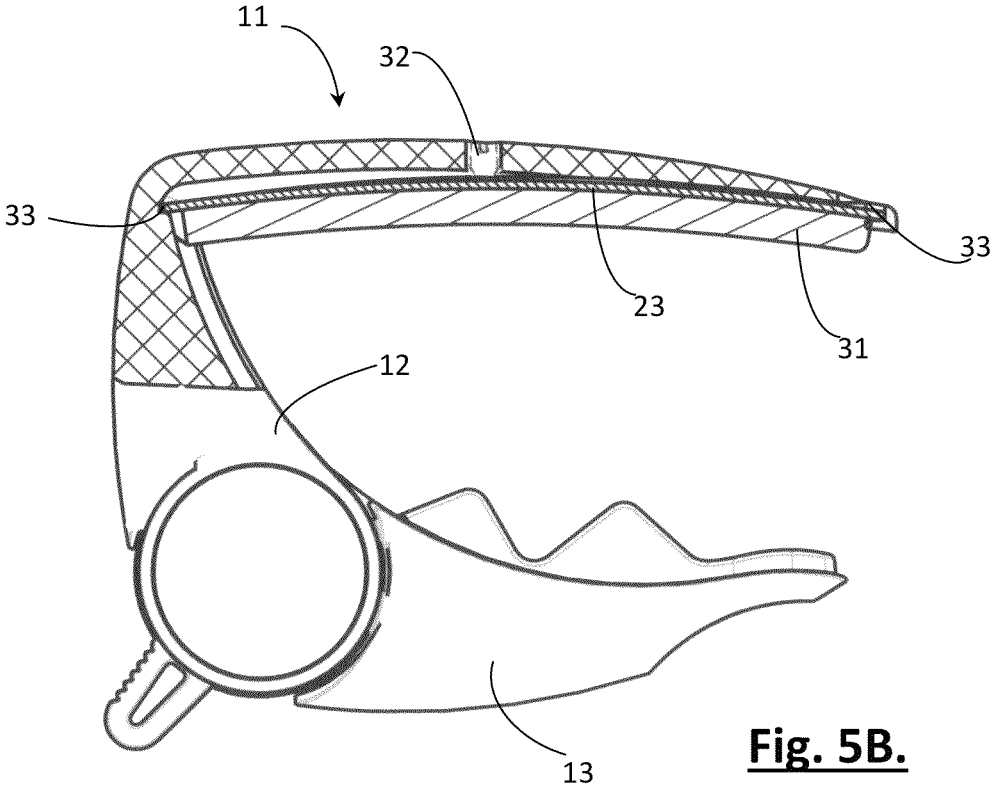

FIGS. 5A and 5B illustrate a further embodiment where a single screw 32, which is a threaded adjustment element and is preferably centrally located upon the first arm, provides an adjustment mechanism to act on a resilient lengthwise element 23 accommodated within said first arm 11. The resilient element 23 preferably includes an inherent curvature that spans between two ledges 33 or equivalent fixing points at each end. Therefore, extending the screw (e.g. by turning clockwise with a screw driver or Allen key) from a string facing underside of first arm 11 will provide a downward force upon and gradual straightening of the element 23, thereby adjusting its curvature toward a flat profile. FIG. 5A illustrates the screw in an extended state which corresponds with a relative flat profile, whereas FIG. 5B illustrates a more curved profile where little or no pressure is applied to resilient element 23. The screw 32 obviously provides fine adjustment to any curve profile in between.

As in previous embodiments, the resilient element (probably constructed from a spring steel or equivalent) is preferably not in direct contact with the instrument strings, but may include a softer covering or spacer element 31 which avoids direct metal on metal contact with the strings.

What all of the foregoing embodiments have in common is that each includes a means to adapt the first arm of the capo to the curvature of the instrument finger board and/or strings. Furthermore, in the most preferred embodiments the adjustment is via an adjustable tensioning means associated lengthwise with the clamp arm. The tensioning means may affect the overall curvature of the clamp arm itself or merely the side to be contactable to instrument strings. Particularly, the tensioning means is able to be adjusted by a single adjustment, e.g. the tightening action of a knob or screw at one end for in the middle) of the clamp arm.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A capo for use with a stringed instrument having a neck with a back and a finger board with strings that extend longitudinally over said finger board, the capo including:

a first arm configured to, in use, extend laterally across the finger board over the strings;

an opposing element configured to, in use, abut against the back of the neck of the instrument to, in cooperation with the first arm, provide a clamping force over the strings; wherein the first arm includes a string contacting surface associated with an adaptive element for, in use, adapting a curvature of the string contacting surface to correspond to a curvature of the finger board and strings when the clamping force is applied over the strings; and a threaded adjustment element for, in use, acting on the adaptive element to adapt the curvature of the string contacting surface.

2. The capo of claim 1 wherein the adaptive element for adapting to the curvature is an adjustable tensioning element.

3. The capo of claim 2 wherein the adjustable tensioning element is operable by a single adjustment operation by the threaded adjustment element.

4. The capo of claim 2 wherein the adjustable tensioning element acts in a lengthwise direction.

5. The capo of claim 2 wherein the tensioning element is anchored at a first end to a portion of the first arm and anchored at a second end to the threaded adjustment element which controls tension in the tensioning element.

6. The capo of claim 5 wherein the tensioning element is a truss rod spanning lengthwise across the first arm, wherein the threaded adjustment element causes a change in curvature of the truss rod.

7. The capo of claim 5 wherein the adjustable tensioning element is a band or cable spanning lengthwise across the first arm, wherein the threaded adjustment element causes a change in taughtness across the cable or band.

8. The capo of claim 1 wherein, in use, the adaptive element is in contact with the string contacting surface via an intermediate element.

9. The capo of claim 8 wherein the intermediate element has a degree of flexibility.

10. The capo of claim 9 wherein the intermediate element is a spacer and/or rubber covering.

11. The capo of claim 1 wherein the first arm is comprised of flexible or resilient material such that a substantive length of the first arm is capable of having a curvature adjusted.

12. The capo of claim 5 wherein the threaded adjustment element includes a threaded bore for receiving a corresponding thread at the second end of the adjustable tensioning element.

13. The capo of claim 12 wherein the threaded adjustment element further includes a rotatable boss accommodated by a bore adjacent an end of the first arm.

14. The capo of claim 13 wherein the boss has a head featuring either a knob or aperture for receiving an Allen key.

15. The capo of claim 13 wherein an end of the boss within the bore includes a pivot pin.

16. The capo of claim 1 wherein the opposing element is any one of or a combination of the following:

a spring loaded lower arm;

a clutch or cam operated lower arm; or an elastic element.

17. The capo of claim 2 wherein the adjustable tensioning element is comprised of a resilient element acted on by the threaded adjustment element that, in use, is in direct contact with, or via an intermediate element, the strings of the instrument.

18. The capo of claim 1 wherein the adaptive element is a resilient element mounted within the first arm, acted on by the threaded adjustment element in the form of an extendable element operable to adjustably abut against the resilient element to adjust the curvature thereof.

19. The capo of claim 18 wherein the extendable element is a screw rotatable within a threaded bore located midway across the first arm.

20. The capo of claim 1 wherein the adaptive element is a resilient element including upstanding flanges at each end that each receive a shaft therethrough and a rotatable element abutting one of the flanges.

21. The capo of claim 1 wherein the string contacting surface is made from a hard material for improving tonal qualities as the stringed instrument is played.

22. The capo of claim 1 wherein the adaptive element is integral with the string contacting surface.

* * * * *